US005175474A

United States Patent [19]

Kakitani et al.

[11] Patent Number: 5,175,474

[45] Date of Patent: Dec. 29, 1992

[54] POWER SOURCE FOR LIGHTING APPARATUS

[75] Inventors: Tsutomu Kakitani, Yokohama; Kenichi Inui, Yokosuka, both of Japan

[73] Assignee: Toshiba Lighting & Technology Group, Tokyo, Japan

[21] Appl. No.: 765,936

[22] Filed: Sep. 26, 1991

[30] Foreign Application Priority Data

Sep. 26, 1990 [JP] Japan ..... 2-254101

[51] Int. Cl.[5] ..... H05B 37/02

[52] U.S. Cl. ..... 315/209 R; 315/208; 315/219; 315/241 R; 315/239; 315/283; 315/DIG. 5; 315/DIG. 7; 315/291

[58] Field of Search ..... 315/208, 209 R, 219, 315/241 R, 239, 283, DIG. 5, DIG. 7, 363, 291

[56] References Cited

U.S. PATENT DOCUMENTS 4,709,188 11/1987 Roberts ..... 315/DIG. 7

*Primary Examiner*—Eugene R. LaRoche
*Assistant Examiner*—Michael B. Shingleton
*Attorney, Agent, or Firm*—Cushman, Darby & Cushman

[57] ABSTRACT

An apparatus for operating discharge lamp. The apparatus includes a source of electrical power, switching devices for switching the electrical power, a control circuit for controlling the switching devices, a transformer having a primary winding for receiving the electrical power switched by the switching devices and a secondary winding for supplying power to the lighting apparatus, a resonant circuit including an inductor and a capacitor for regulating the frequency of the electrical power and a circuit for powering the control circuit, the powering circuit including a secondary winding on the inductor and an additional winding on the transformer connected in a differential manner.

9 Claims, 6 Drawing Sheets

Fig. 4A. NO-LOAD

Fig. 4B. LOAD

Fig. 4C. SHORT

POWER SOURCE FOR LIGHTING APPARATUS

FIELD OF THE INVENTION

The present invention relates generally to an appratus for operating discharge lamp, and more particularly, to an appratus for operating discharge lamp with a high frequency power source.

BACKGROUND OF THE INVENTION

An appratus for operating a discharge lamp is generally required for operating a discharge lamp. FIG. 1 shows an example of conventional apparatus for operating discharge lamps. The apparatus for operating discharge lamps has a rectifier 2, a smoothing circuit 3, an inverter circuit 4, an output transformer 11 and a discharge lamp 12. The rectifier 2 is adapted for rectifying a commercial frequency power, such as a 50/60 Hz, 100/200 V power from a commercial power supply 1.

The rectified signal from the rectifier 2 is supplied to the inverter circuit 4 through the smoothing circuit 3. The smoothing circuit 3 removes undesired ripples from the rectified signal. The rectifier 2 is a full-wave rectifier. The smoothing circuit 3 is a voltage-split type smoothing circuit. The full-wave rectifier and the voltage-split type smoothing circuit are well-known in the art, so that detailed descriptions thereof are omitted herein. The output transformer 11 includes a primary winding 11*a* and a secondry winding 11*b*.

The inverter circuit 4 includes a series circuit of FETs 5 and 6, a choke 7, a control circuit 8, a capacitor 9, a diode 10 and a series circuit of coupling capacitors 17*a* and 17*b*. The series circuit of FETs 5 and 6 provides a switching operation for the rectified voltage from the smoothing circuit 3. The choke 7 has a primary winding 7*a* and a secondary winding 7*b*. The series circuit of the FETs 5, 6 and the series circuit of the coupling capacitors 17*a*, 17*b* are respectively connected across the rectifier 2. The gates of the FETs 5, 6 are connected to outputs of the control circuit 8 so that they are alternately turned ON or OFF at a high frequency under a control of the control circuit 8. The primary winding 11*a* of the output transformer 11 is coupled between the coupling node of the FETs 5, 6 and the coupling node of the coupling capacitors 17*a* and 17*b* through the choke 7. The secondary winding 11*b* is connected to the discharge lamp 12. The capacitor 9 is coupled across the primary winding 11*a* of the output transformer 11.

Thus a high frequency AC current flows through a resonant circuit consisting of the primary winding 7*a* of the choke 7 and the capacitor 9. An output voltage corresponding to the high frequency AC current is produced on the primary winding 11*a* of the output transformer 11. The secondary winding 7*b* of the choke 7 is coupled to inputs of the control circuit 8 through the diode 10. Thus an induced voltage responsive to the high frequency AC current appears on the secondary winding 7*b* of the choke 7 and then rectified by the diode 10.

A rectified voltage is inputted to the control circuit 8 as a DC power source. The regulated high frequency AC current is outputted to the discharge lamp 12 through the output transformer 11. In the output transformer 11, the primary winding 11*a* is connected in parallel with the capacitor 9 so that a boosted high frequency AC voltage is generated on the second winding 11*b* for lighting the discharge lamp 12.

In the above example of the conventional apparatus for discharge lamp, the DC power source required for driving the control circuit 8 of the inverter circuit 4 is generated by the secondary winding 7*b* of the choke 7.

Further, FIG. 2 is a block diagram showing another example of the conventional apparatus for operating discharge lamp. This example differs from the above in that an additional winding 11*c* is coupled to the output transformer 11 in place of the secondary winding 7*b* of the choke 7. In this latter example, the DC power, required for the control circuit 8 is generated at the additional winding 11*c* of the output transformer 11.

In both these conventional apparatus for operating discharge lamp, the DC power source for the control circuit 8 is obtained from the secondary windings 7*b* of the choke 7 or the additional winding 11*c* of the output transformer 11. Therefore, if the high frequency AC current flowing through the choke 7 and the transformer 11 has changed, the DC power source to the control circuit 8 also changes in response to the change and interferes with the stable operation of the control circuit 8.

SUMMARY OF THE INVENTION

It is, therefore, an object of the present invention to provide an appratus for operating a discharge lamp which is able to stably light a discharge lamp.

Another object of the present invention is to provide an appratus for operating discharge lamp which is able to generate a stable DC power source for a control circuit of an inverter circuit.

In order to achieve the above objects, an appratus for operating discharge lamp according to one aspect of the present invention includes a source of electrical power, switching devices for switching the electrical power, a control circuit for controlling the switching devices, a transformer having a primary winding for receiving the electrical power switched by the switching devices and a secondary winding for supplying power to the lighting apparatus, a resonant circuit including an inductor and a capacitor for regulating the frequency of the electrical power and a circuit for powering the control circuit, the powering circuit including a secondary winding on the inductor and an additional winding on the transformer connected in a differential manner.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
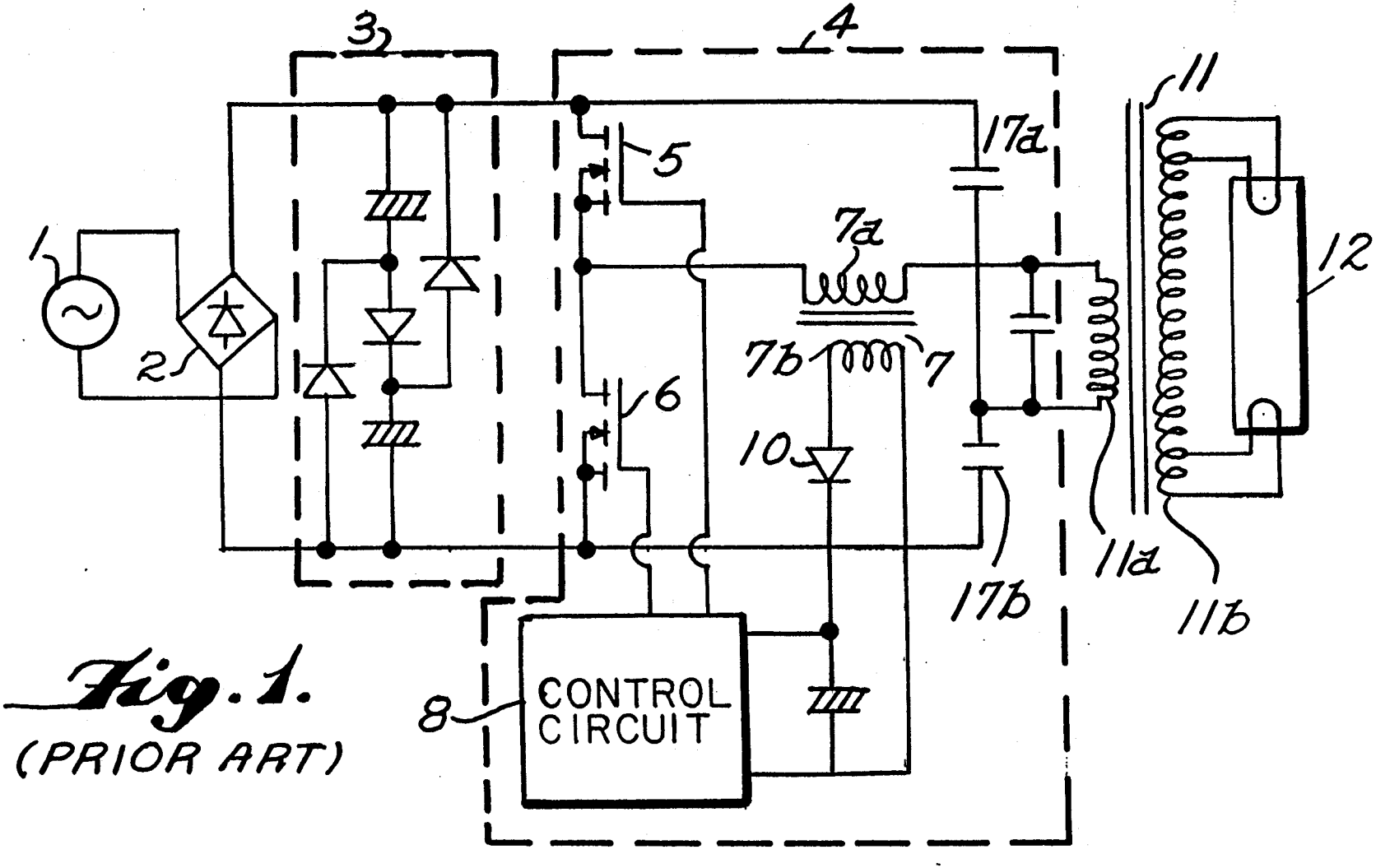
Fig. 1. (PRIOR ART)
FIGS. 1 and 2 are schematic diagrams showing examples of conventional apparatus for operating discharge lamp.

The present invention will be described in detail with reference to the FIGS. 3 through 6. Throughout the drawings, reference numerals or letters used in FIGS. 1 and 2 will be used to designate like or equivalent elements for simplicity of explanation.

Figure 2:
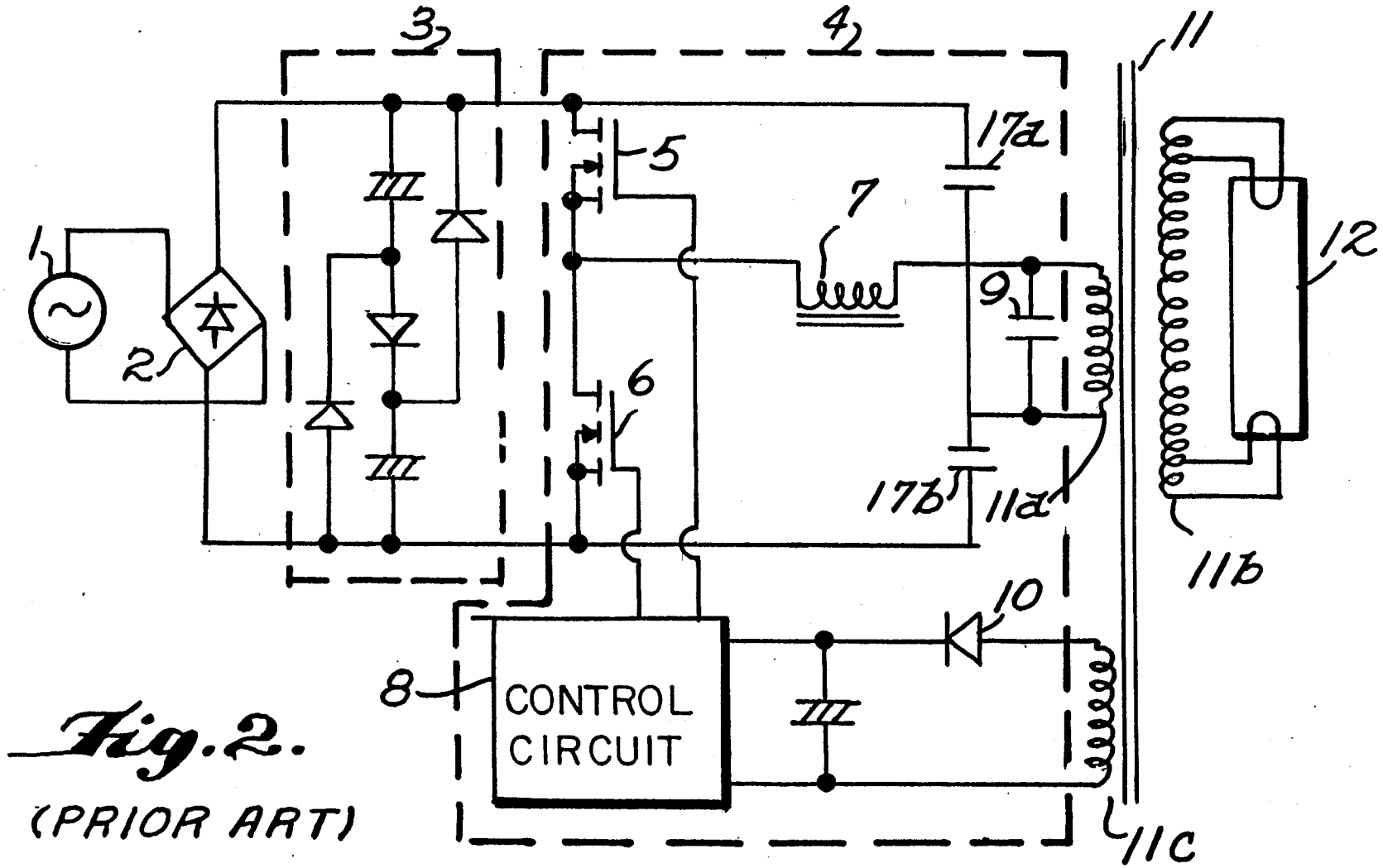
Fig. 2. (PRIOR ART)
Figure 3:
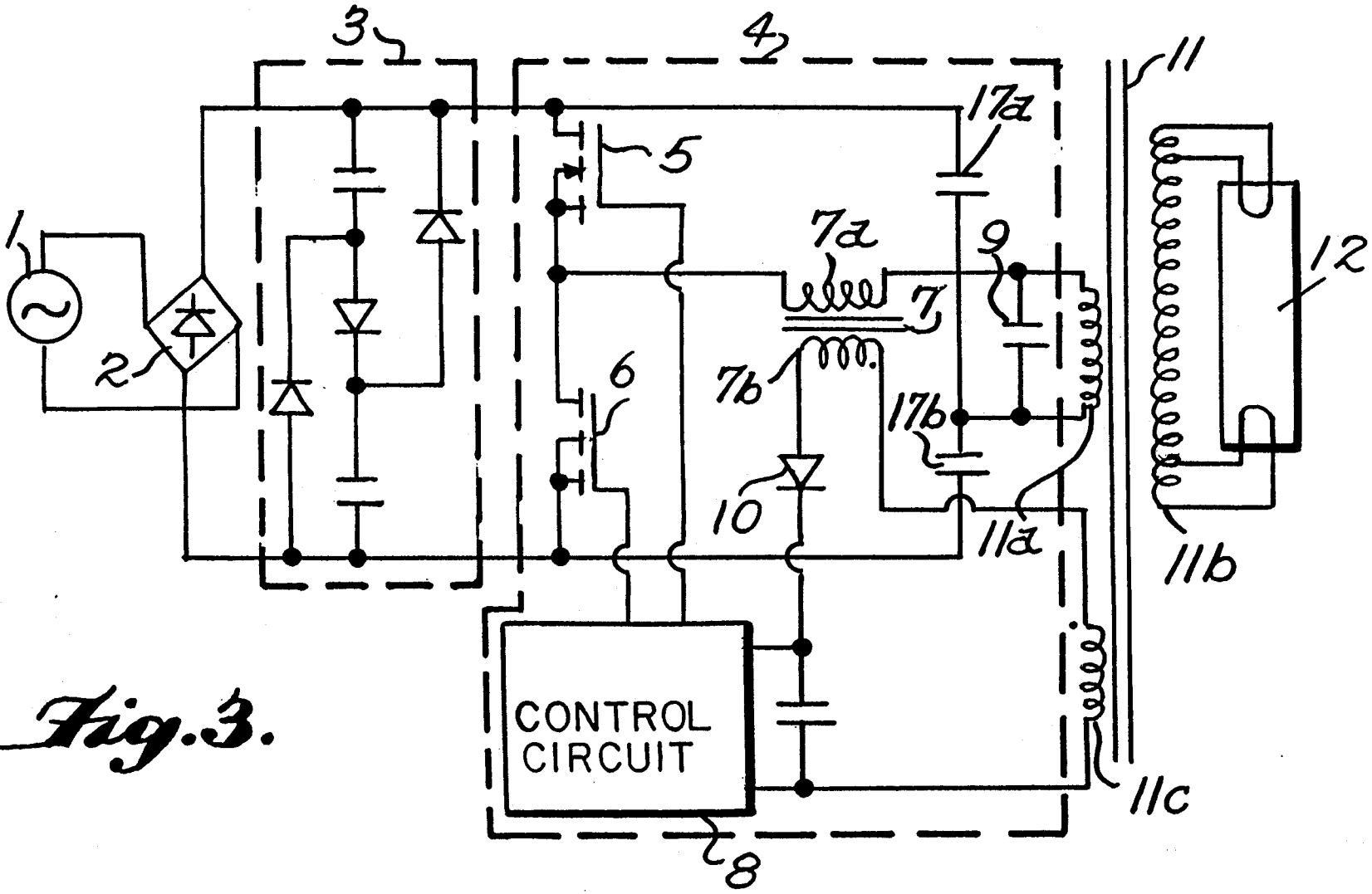
FIG. 3 is a block diagram showing an embodiment of the apparatus for operating discharge lamp according to the present invention.

Referring now to FIG. 3, a first embodiment of the apparatus for operating discharge lamp according to the present invention will be described in detail. As shown in FIG. 3, the apparatus for operating discharge lamp has a rectifier 2, a smoothing circuit 3, an inverter circuit 4, an output transformer 11 and a discharge lamp 12. The rectifier 2 is adapted for rectifying a commercial frequency power of 50/60 Hz, 100/200 V from a commercial power supply 1. The rectified voltage from the rectifier 2 is supplied to the inverter circuit 4 through the smoothing circuit 3. The smoothing circuit 3 removes undesired ripples in the rectified voltage. The rectifier 2 and the smoothing circuit 3 are well-known and identical with those in the conventional apparatus of FIGS. 1 and 2 so that detailed descriptions thereof are also omitted herein. The output transformer 11 includes a primary winding 11*a*, a secondary winding 11*b* and an additional winding 11*c*.

The inverter circuit 4 includes a series circuit of FETs 5 and 6, a choke 7, a control circuit 8, a capacitor 9, a diode 10 and a series circuit of coupling capacitors 17*a* and 17*b*. The series circuit of FETs 5 and 6 provides a switching operation for the rectified voltage from the smoothing circuit 3. The choke 7 has a primary winding 7*a* and a secondary winding 7*b*. The series circuit of the FETs 5, 6 and the series circuit of the coupling capacitors 17*a*, 17*b* are respectively connected across the rectifier 3. The gates of the FETs 5, 6 are connected to outputs of the control circuit 8 so that they are alternately turned ON or OFF at a high frequency under control of the control circuit 8.

The primary winding 11*a* of the output transformer 11 is coupled between the coupling node of the FETs 5, 6 and the coupling node of the coupling capacitors 17*a* and 17*b* through the choke 7. The secondary winding 11*b* is connected to the discharge lamp 12. The capacitor 9 is coupled across the primary winding 11*a* of the output transformer 11. Thus a high frequency AC current flows through a resonant circuit consisting of the primary winding 7*a* of the choke 7 and the capacitor 9.

An output voltage corresponding to the high frequency AC current is generated on the primary winding 11*a* of the output transformer 11. The secondary winding 7*b* of the choke 7 is coupled to inputs of the control circuit 8 through the diode 10 and the additional winding 11*c* of the output transformer 11. Thus an induced voltage responsive to the high frequency AC current appears on the secondary winding 7*b*. Another induced voltage also responsive to the high frequency AC current appears on the additional winding 11*c* of the output transformer 11.

These two induced voltages are rectified by the diode 10, and then input to the control circuit 8 as a DC power source. The regulated high frequency AC current is output to the discharge lamp 12 through the output transformer 11. In the output transformer 11, the primary winding 11*a* is connected in parallel with the capacitor 9 so that a boosted high frequency AC voltage is generated on the second winding 11*b* for lighting the discharge lamp 12.

In this embodiment of the apparatus for operating discharge lamp, the secondary winding 7*b* of the choke 7 and the additional winding 11*c* of the output transformer 11 are connected together in series. Thus the DC power source required for driving the control circuit 8 of the inverter circuit 4 is generated by both the secondary winding 7*b* of the choke 7 and the additional winding 11*c* of the output transformer 11. However, these windings 7*b* and 11*c* are coupled differentially in terms of winding polarity relation so that their induced voltages are differentially combined in this series circuit.

Figure 4:
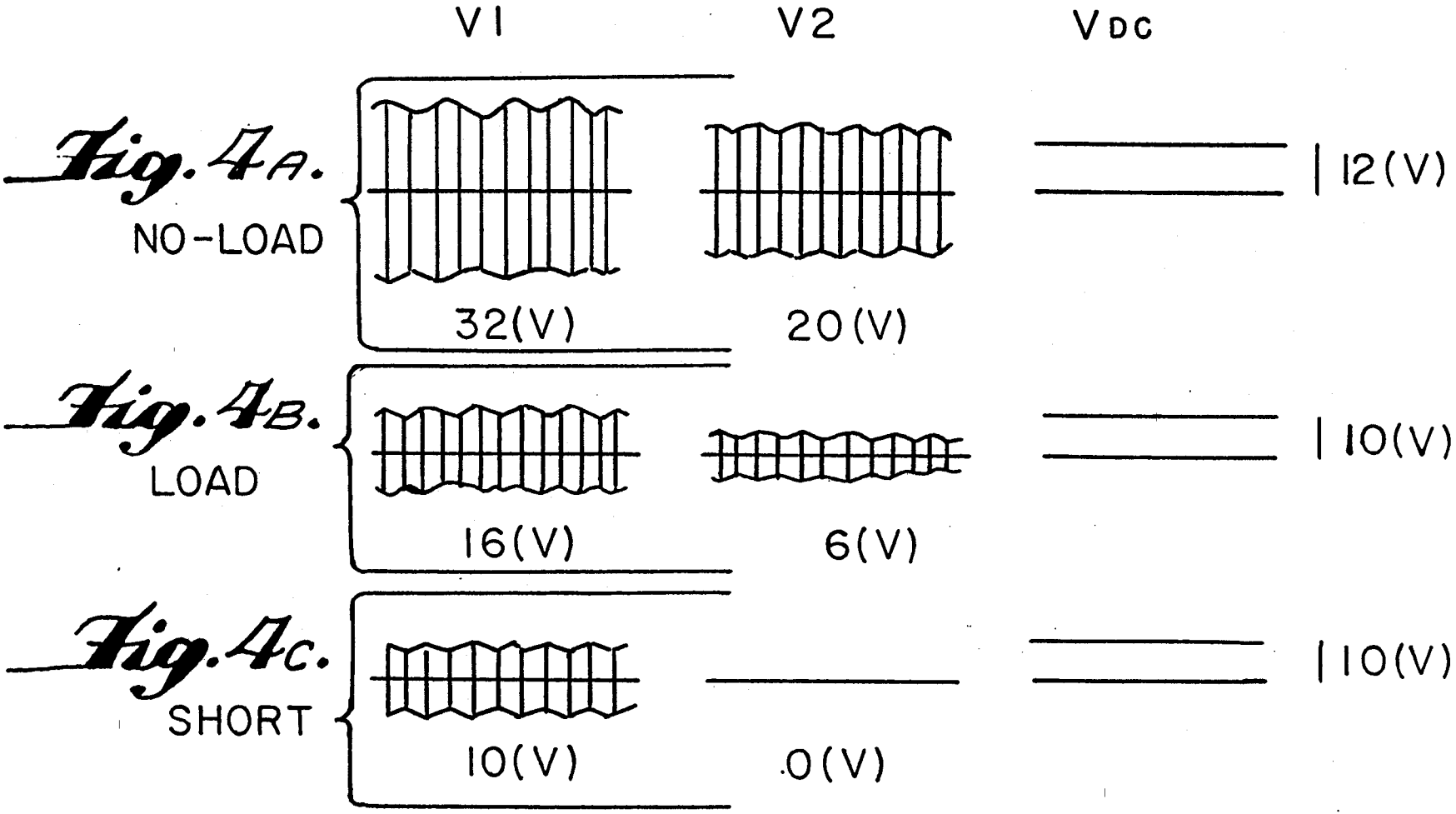
FIGS. 4*a–c* in an explanatory diagram showing voltage by the secondary windings and their differential voltage.

Referring now to FIG. 4, the induced voltage V1 appearing on the secondary winding 7*b* of the choke 7, the induced voltage V2 appearing on the additional winding 11*c* of the output transformer 11 and the DC voltage Vdc of the DC power source to the control circuit 8 will be described in detail. The DC voltage Vdc of the DC power source is results from the differential combination of the induced voltages V1 and V2.

When the discharge lamp 12 is not loaded to the output transformer 11, a large amount of current flows through the primary winding 7*a* of the choke 7 and the primary winding 11*a* of the output transformer 11. Accordingly, the induced voltage V1 with, e.g., 32 V, the induced voltage V2 with, e.g., 20 V are combined and correspondingly a DC power source of 12 V is obtained, as shown in FIG. 4(A).

When the discharge lamp 12 is loaded to the output transformer 11, the high frequency AC current flowing through the primary winding 7*a* of the choke 7 and the primary winding 11*a* of the output transformer 11 decreases. Accordingly, the induced voltages V1 and V2 and the voltage Vdc of the DC power source decrease to 16 V, 6 V, and 10 V, respectively, as shown in FIG. 4(B).

Further, if both ends of the discharge lamp 12 are shorted, the induced voltages V1 and V2 decrease to 10 V and 0V, respectively, while the voltage Vdc of the DC power source remains voltage 10 V, the same as the load condition, as shown in FIG. 4(C).

As may be easily understood from the above description, even when the induced voltages V1 and V2 appearing on the windings 7*a* and 11*c* vary in response to load conditions, the DC power source obtained by differential combination of the induced voltages V1 and V2 stays almost constant, or within a relatively short voltage range, e.g., the range from 10 V to 12 V.

Therefore, it becomes possible to prevent a large fluctuation of the DC power source to the control circuit 8 so that the FETs 5 and 6 can be stably operated.

Figure 5:
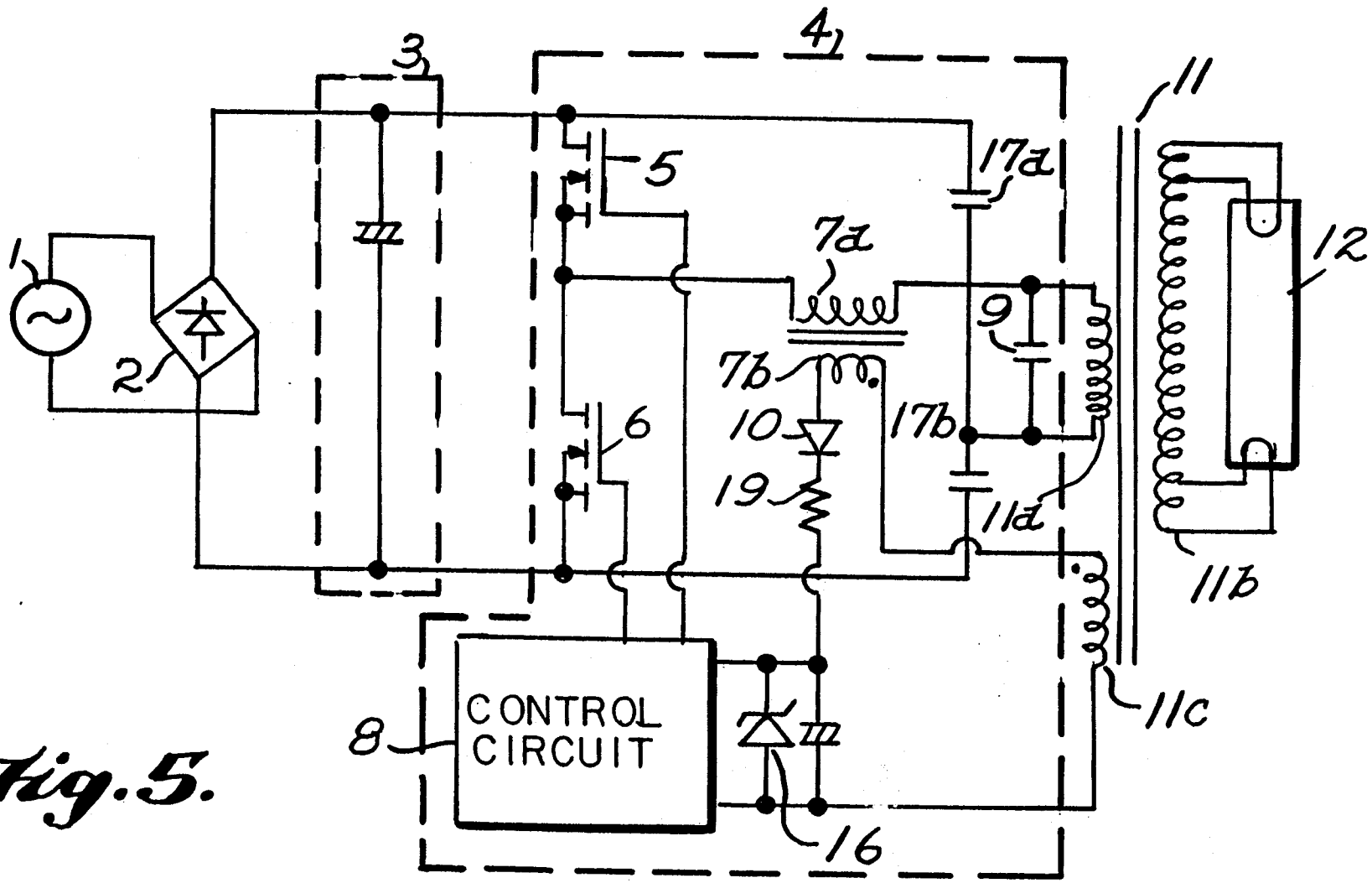
FIG. 5 is the block diagram showing a first modification of this embodiment.

In the above embodiment, the smoothing circuit 3 is a voltage-split type smoothing circuit, similar to the examples of the conventional discharge lamp lighting apparatus as shown FIGS. 1 and 2. However, the smoothing circuit 3 is not limited to the voltage-split type smoothing circuit for example, the smoothing circuit 3 can be replaced by a single smoothing capacitor 15, as shown in FIG. 5. FIG. 5 shows a block diagram of a first modification of this embodiment.

Further, a dropping resistor 19 can be inserted in series with the diode 10, or a zener diode 16 can be couple across the inputs of the control circuit 8, for further stabilizing the DC power pource to be applied to the control circuit 8.

Figure 6:
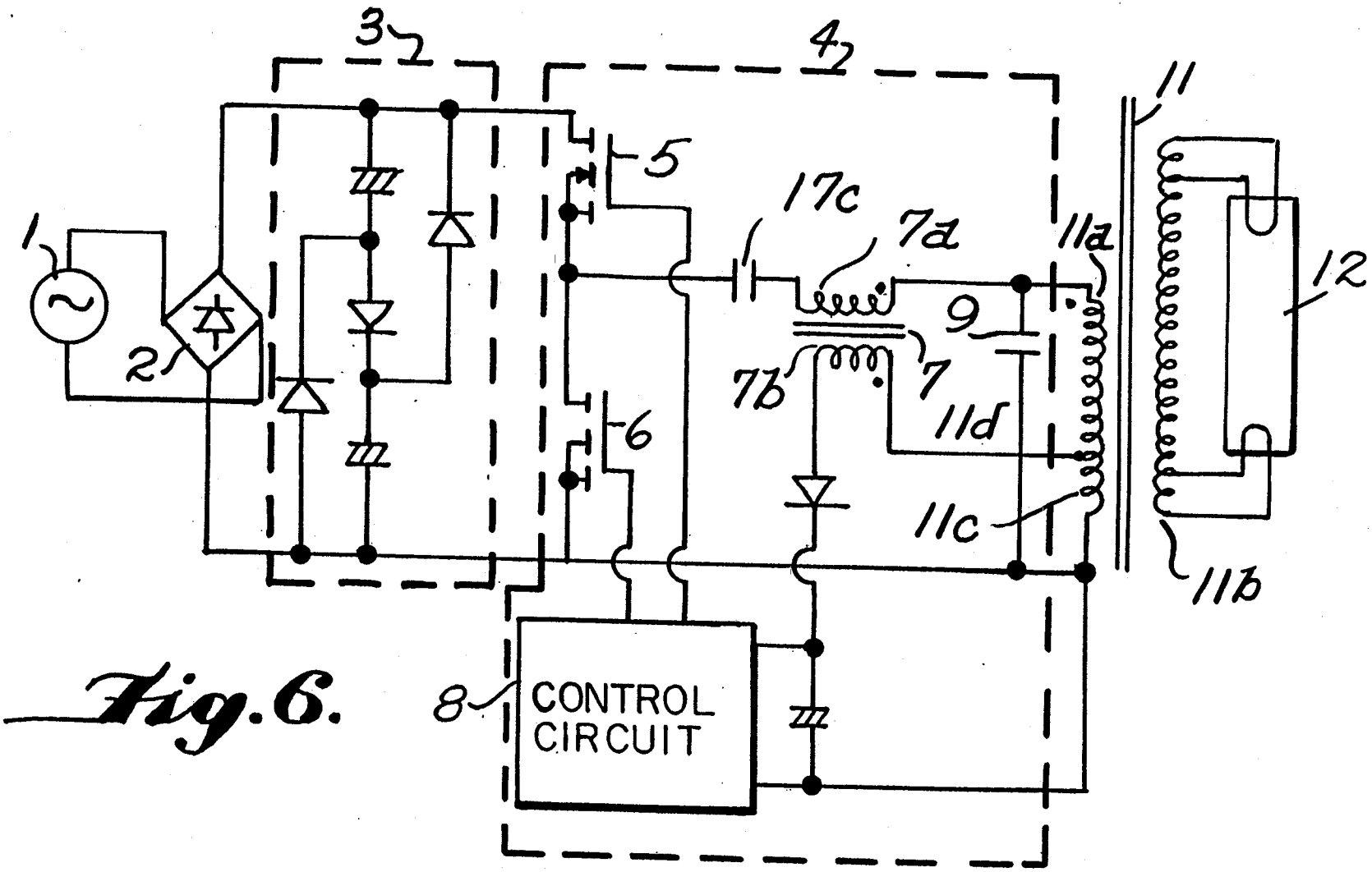
FIG. 6 is the block diagram showing a second modification of this embodiment.

Referring now to FIG. 6, a second modification of the apparatus for operating discharge lamp will be briefly described below. As shown in FIG. 6, this second modification differs from the above embodiment, e.g., the apparatus of FIG. 3 as follows. That is, an additional winding 11*c* is provided by using a part of the primary winding 11*a* of the transformer 11. Thus, a tap 11*d* provided on the primary winding 11*a* is coupled to the secondary winding 7*b* of the choke 7. Further, one end of the primary winding 11*a* of the transformer 11 is coupled with the connecting node of the FETs 5 and 6 through a coupling capacitor 17*c* as well as the choke 7, while another end of the primary winding 11*a* is directly coupled with only the other end of the FET 6. In this modification, the apparatus for operating discharge lamps is advantageous for simplifying the construction in comparison to the embodiment of FIG. 3.

As described above, the present invention can provide an extremely preferable apparatus for operating discharge lamp.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An apparatus for operating discharge lamp, comprising:

a source of electrical power;

switching means for switching the electrical power;

control means for controlling the switching means;

transformer means having a primary winding for receiving the electrical power switched by the switching means and a secondary winding for supplying power to the lighting apparatus;

a resonant circuit including an inductor and a capacitor for regulating the frequency of the electrical power; and a circuit for powering the control means, said circuit including a secondary winding on the inductor and an additional winding on the transformer means connected in a differential manner.

2. An apparatus for operating discharge lamp as in claim 1, wherein the additional winding on the transformer means comprises an additional tap onto the primary winding of the transformer means.

3. An apparatus for operating discharge lamp as in claim 1, further including a coupling circuit for coupling the electrical power from the switching means to the primary winding of the transformer means.

4. An apparatus for operating discharge lamp as in claim 1, wherein the coupling means includes at least one capacitor connected between the switching means and the transformer means.

5. An apparatus for operating discharge lamp as in claim 1, wherein the switching means comprises at least two switching elements connected in series, with their control terminals connected to the control means.

6. An apparatus for operating discharge lamp as in claim 5, wherein the switching elements comprises transistors.

7. An apparatus for operating discharge lamp as in claim 5, wherein the switching elements comprises FETs.

8. An apparatus for operating discharge lamp as in claim 1, wherein the circuit for powering the control means also includes means for stabilizing the voltage supplied to the control means.

9. An apparatus for operating discharge lamp as in claim 8, wherein the means for stabilizing includes a zener diode.

* * * * *